United States Patent [19]

Clarke, Jr. et al.

[11] Patent Number: 4,808,026

[45] Date of Patent: Feb. 28, 1989

[54] CONSTRUCTION APPARATUS WITH EARTH TRIMMER

[75] Inventors: Samuel Y. Clarke, Jr., Mocksville; Clifford J. Griffith, Jr., Clemmons, both of N.C.

[73] Assignee: Power Curbers, Inc., Salisbury, N.C.

[21] Appl. No.: 145,831

[22] Filed: Jan. 19, 1988

Related U.S. Application Data

[63] Continuation-in-part of Ser. No. 125,999, Nov. 27, 1987.

[51] Int. Cl.[4] ..... E01C 23/12; E01C 11/22

[52] U.S. Cl. ..... 404/90; 404/98; 404/104; 299/39; 37/108 R; 172/108

[58] Field of Search ..... 404/90, 91, 96, 98, 404/104, 84; 299/36–40; 37/108 R, 108 A, DIG. 13, DIG. 20; 172/4.5, 107–109

[56] References Cited

U.S. PATENT DOCUMENTS

| | | | |
|---|---|---|---|
| 3,130,654 | 4/1964 | Apel et al. | 404/104 |
| 3,554,291 | 1/1971 | Rogers et al. | 172/4.5 |
| 3,767,262 | 10/1973 | Pentith | 299/39 X |
| 3,778,110 | 12/1973 | Staab | 299/39 |
| 3,779,661 | 12/1973 | Godbersen | 404/98 X |
| 3,904,245 | 9/1975 | Clarke | 299/37 |
| 3,914,064 | 10/1975 | Gurries | 404/84 |
| 4,154,481 | 5/1979 | Heckenhauer et al. | 299/39 |
| 4,175,886 | 11/1979 | Moench et al. | 404/90 |
| 4,197,032 | 4/1980 | Miller | 404/98 |
| 4,403,889 | 9/1983 | Gillotti | 404/84 X |
| 4,701,069 | 10/1987 | Whitney | 404/96 X |
| 4,714,374 | 12/1987 | Mihara | 404/91 |

*Primary Examiner*—Stephen J. Novosad
*Assistant Examiner*—John F. Letchford
*Attorney, Agent, or Firm*—Bell, Seltzer, Park & Gibson

[57] ABSTRACT

A construction apparatus with a trimmer connected by a three-point suspension wherein each of the three points is independently adjustable for adjusting the angle of the trimmer relative to the main frame in accordance with the desired slope or grade of the ground surface and to raise and lower the trimmer. The trimmer is also provided with an improved carriage for permitting the trimmer to be moved laterally outwardly of the construction apparatus to grade the ground surface alongside the construction apparatus. The construction apparatus preferably molds a paving material onto the ground immediately behind the trimmer so that concurrent grading and molding is accomplished in one pass of the construction apparatus.

19 Claims, 4 Drawing Sheets

CONSTRUCTION APPARATUS WITH EARTH TRIMMER

This application is a continuation-in-part of copending application Ser. No. 125,999 filed Nov. 27, 1987, and entitled "Self-Propelled Construction Apparatus."

This invention relates to a trimmer apparatus for grading the round surface in preparation for forming paving material on the ground surface. More particularly, this invention is directed to a trimmer apparatus that is carried by a construction apparatus, preferably of the self-propelled type, wherein the trimmer is mounted by a three-point suspension and each of the three points is individually adjustable. With this improvement, the operator can easily raise, lower, and adjust the angle of the trimmer in accordance with the slope or grade of the ground surface.

A further aspect of the invention is directed to a carriage for supportingly suspending the trimmer from a main frame of a construction apparatus with the carriage being arranged for movement of the trimmer laterally outwardly to one side of the construction apparatus. This permits readily grading the ground surface underneath and alongside of the construction apparatus.

A further feature of the present invention is directed to a trimmer and carriage as described carried by a construction apparatus, and wherein the construction apparatus also carries a mold for forming a strip of paving material and the trimmer is arranged for grading the ground surface ahead of or in front of the mold so the construction apparatus concurrently grades the ground and forms the paving material on the graded ground surface. This allows the operator to do the entire operation in one pass.

Some of the features of the invention having been stated, others will appear as the description proceeds when taken in connection with the accompanying drawings, in which—

DETAILED DESCRIPTION OF THE INVENTION

Figure 1:
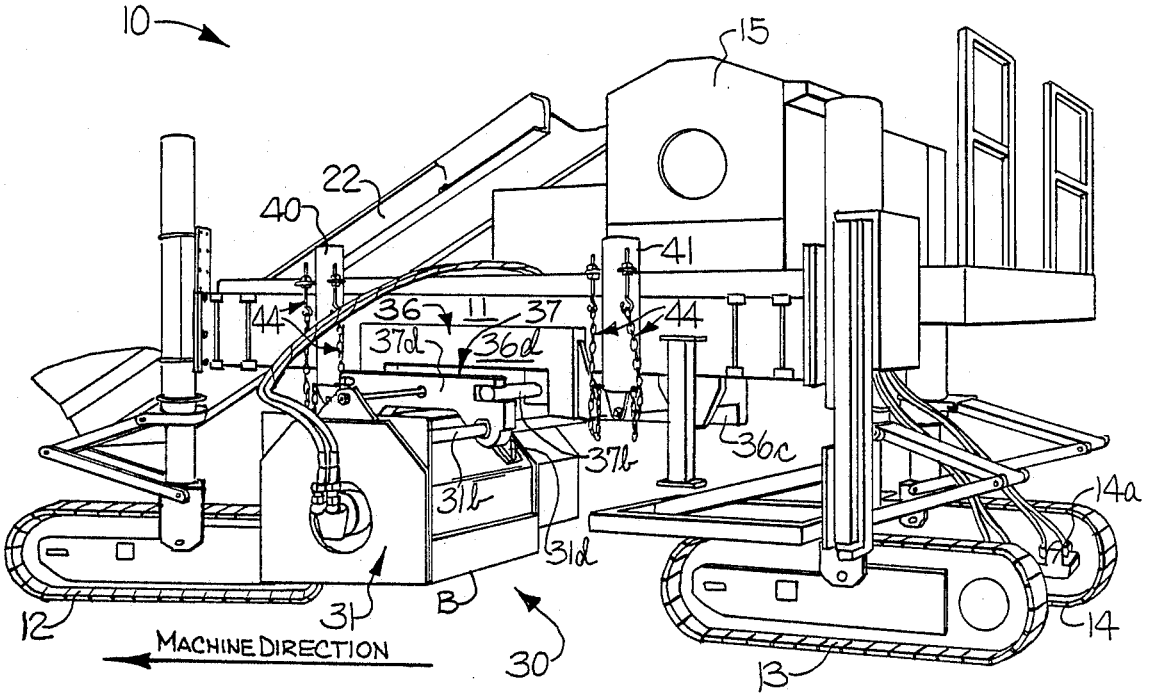
FIG. 1 is a rear perspective view looking at the rear and left-hand side of the construction apparatus showing the trimmer apparatus extending outwardly to the left-hand side of the construction apparatus.
Figure 2:
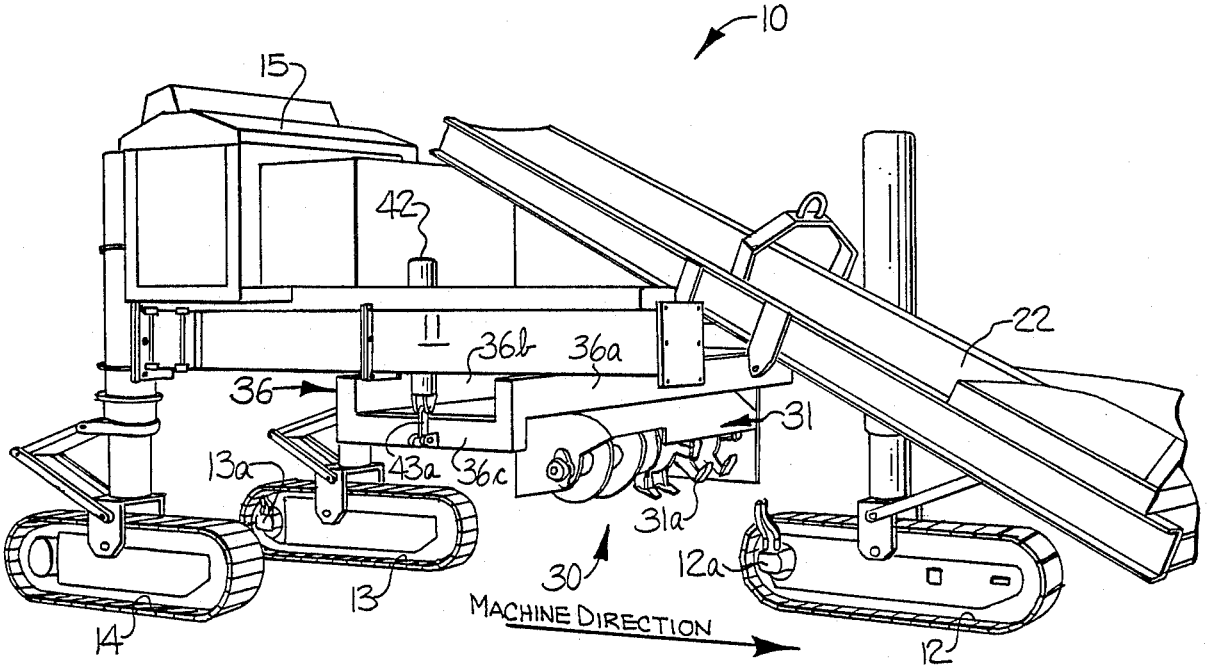
FIG. 2 is a perspective view looking at the front and right-hand side of the construction apparatus.

Referring to the drawings, particularly FIGS. 1 and 2, the preferred embodiment of the construction apparatus is indicated generally at 10. The construction apparatus comprises a main frame 11 supported by ground engaging members 12, 13 and 14, which are preferably tracks as shown. A conventional prime mover 15 and a hydraulic pump (not shown) are carried by the main frame to operate the various systems and attachments to the apparatus. Hydraulic motors 12*a*, and 13*a* (FIG. 2) and 14*a* (FIG. 1) are connected to the hydraulic pump to propel the construction apparatus along the ground surface.

A trimmer apparatus generally indicated at 30 is shown attached to the main frame 11 for grading the ground surface in preparation for forming a paving material on the ground surface. The trimmer apparatus comprises two basic operating components. The first component is the rotating digger 31*a* (FIG. 2) which digs into the earth to loosen and redistribute the soil. The digger 31*a* is followed by an elongate scraper blade B (FIG. 1) which levels the loosened earth to the desired angle and level. The trimmer apparatus has certain common features with the apparatus described in commonly owned U.S. patent to Miller, U.S. Pat. No. 4,197,032, which is incorporated by reference herein.

Figure 3:
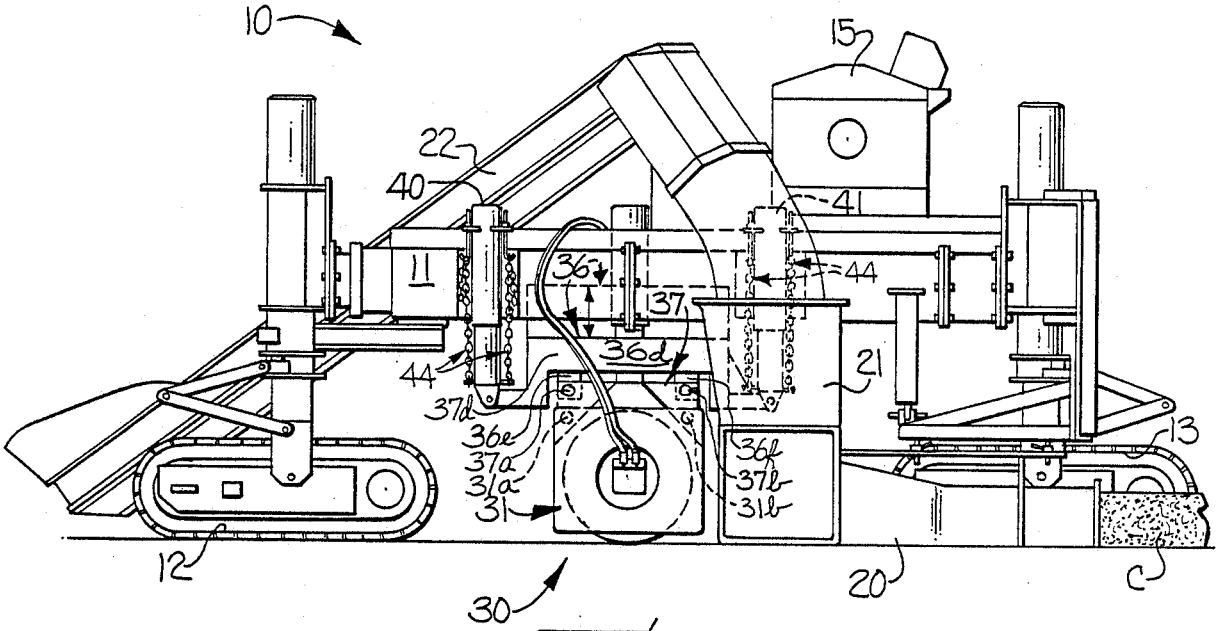
FIG. 3 is a left-hand side elevation of the construction apparatus with the trimmer apparatus attached to its main frame, and with a mold attached to the main frame behind the trimmer apparatus for concurrently grading and molding a paving material on the graded ground surface.
Figure 4:
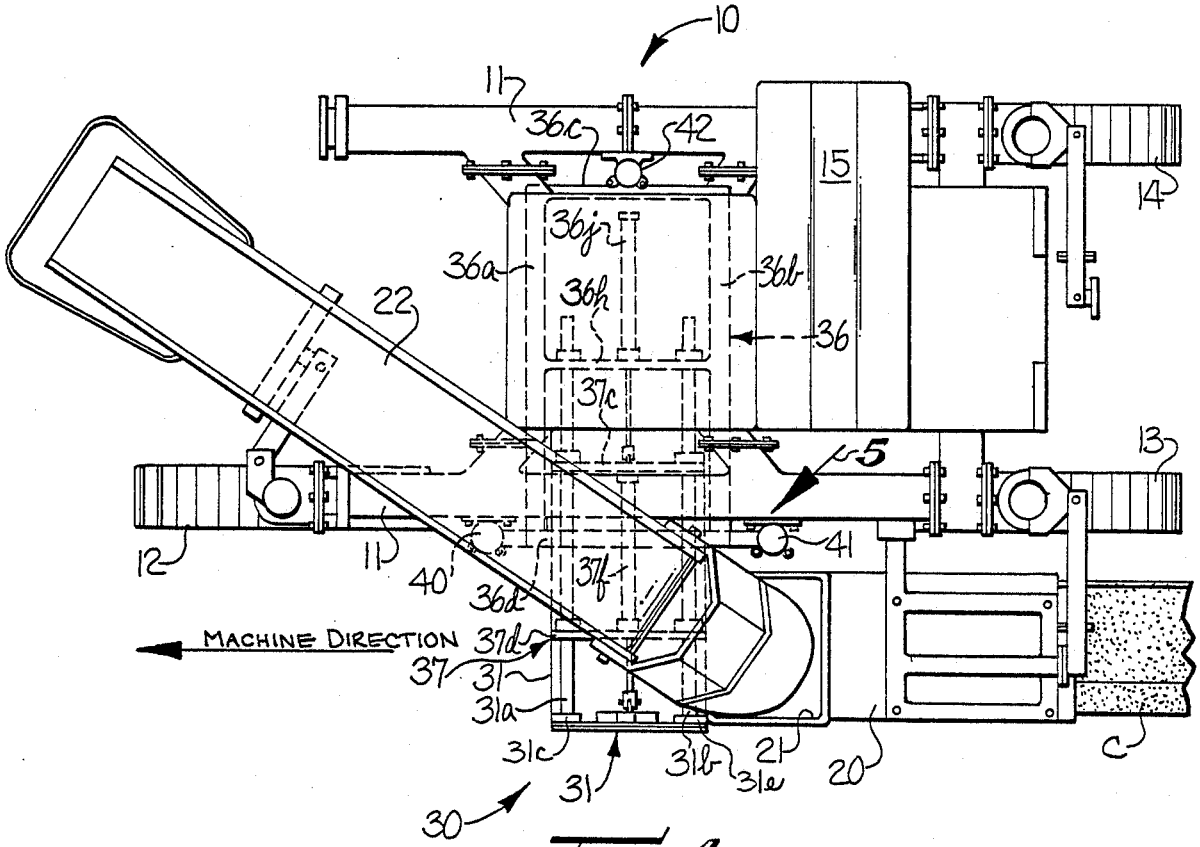
FIG. 4 is a top plan view of the apparatus as shown in FIG. 3.

Referring to FIGS. 3 and 4, the construction apparatus 10 is shown with a mold 20 located rearwardly of the trimmer apparatus generally indicated at 30 for concurrent trimming and molding. However, the mold may be selectively removed in some instances for certain operations. The mold 20 is shown mounted on the left-hand side of the main frame 11 for offset molding, although it is to be understood that it could be mounted on either side. In operation, concrete preferably from a concrete mixing truck (not shown) delivers concrete to the bottom portion of an inclined conveyor 22. The conveyor 22 moves the concrete into the hopper 21 and then into the mold 20. As the machine progresses along a predetermined path, the molded concrete C is extruded out the back portion of the mold 20.

The trimmer apparatus comprises an earth grading means 31 and a carriage which comprises a main carriage 36 and an auxiliary carriage 37 (FIGS. 5–9). Fluid actuated cylinder connectors 40, 41 and 42, which are preferably of the fluid pressure type, connect the carriage, as at 43, to the main frame 11 of the construction apparatus 10 and serves as a three-point suspension for the trimmer apparatus. The fluid actuated cylinder connectors 40, 41 and 42 may be constructed in the same manner substantially as shown more in detail in FIG. 10. Front left-hand fluid actuated cylinder connector 40 is illustrated by way of example although it is understood that fluid actuated cylinder connectors 41 and 42 may be constructed similarly. Accordingly, it will be observed that fluid actuated cylinder connector 40 is formed of concentrically engaged telescoping tubes 40*a* and 40*b*. A fluid cylinder and piston assembly 40*c* is provided internal of the concentric tubes and connected to the outside tube 40*a*. A piston rod 40*d* is connected to the other concentric tube 40*b*.

The fluid actuated cylinder connectors are preferably bolted to the main frame 11 by bolts 43*b* (FIG. 6); but it is understood that the fluid actuated cylinder connectors may be attached by any conventional means. Each fluid actuated cylinder connector is independently operable to provide the operator with a substantial range of adjustment of the trimmer apparatus, so that the ground can be graded to any desirable angle and level. The fluid actuated cylinder connectors can further adjust the angle of attack of the trimmer, or more precisely, the depth of the rotating digger 31*a* relative to the elongate scraper blade B. This controls the thickness of the loosened earth upon which the paving material is molded.

Figure 10:
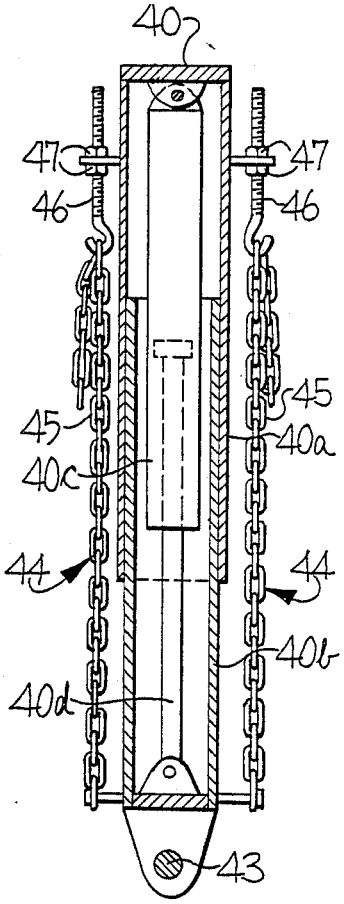
FIG. 10 is a schematical vertical sectional view through one of the three fluid actuated cylinder connectors that serve to connect the carriage to the main frame of the construction apparatus and showing a depth limiting means attached thereto.

Parallel to the concentric tubes 40*a* and 40*b* are a pair of depth limiting means 44 (FIG. 10). The limiting means is preferably comprised of a chain 45 attached to the respective upper tube 40*a* by an adjustment bolt 46. The adjustment bolt 46 is held to a top flange of the outer concentric tube 40*a* by a pair of nuts 47. The limiting means limits the extension of the fluid pressure actuating means relative to the main frame 11 so that, in operation, the operator preadjusts the limiting means to allow the trimmer to be operated at a selected depth and angle. The operator is then able to simply direct the fluid actuated cylinders to force the trimmer down until the chains pull taut. The trimmer is then in its selected operating position. If a manhole or other obstruction were to lie in the path of the trimmer, the operator would simply raise the trimmer to pass over the obstruction and lower the trimmer back down until the chains pull taut again. The operator does not have to slow down the machine or spend a lot of time adjusting the trimmer into the proper position. This improves the quality of the final product because the rate of movement of the apparatus remains constant and the trimmer depth is correct for the maximum portion of the path.

Figure 5:
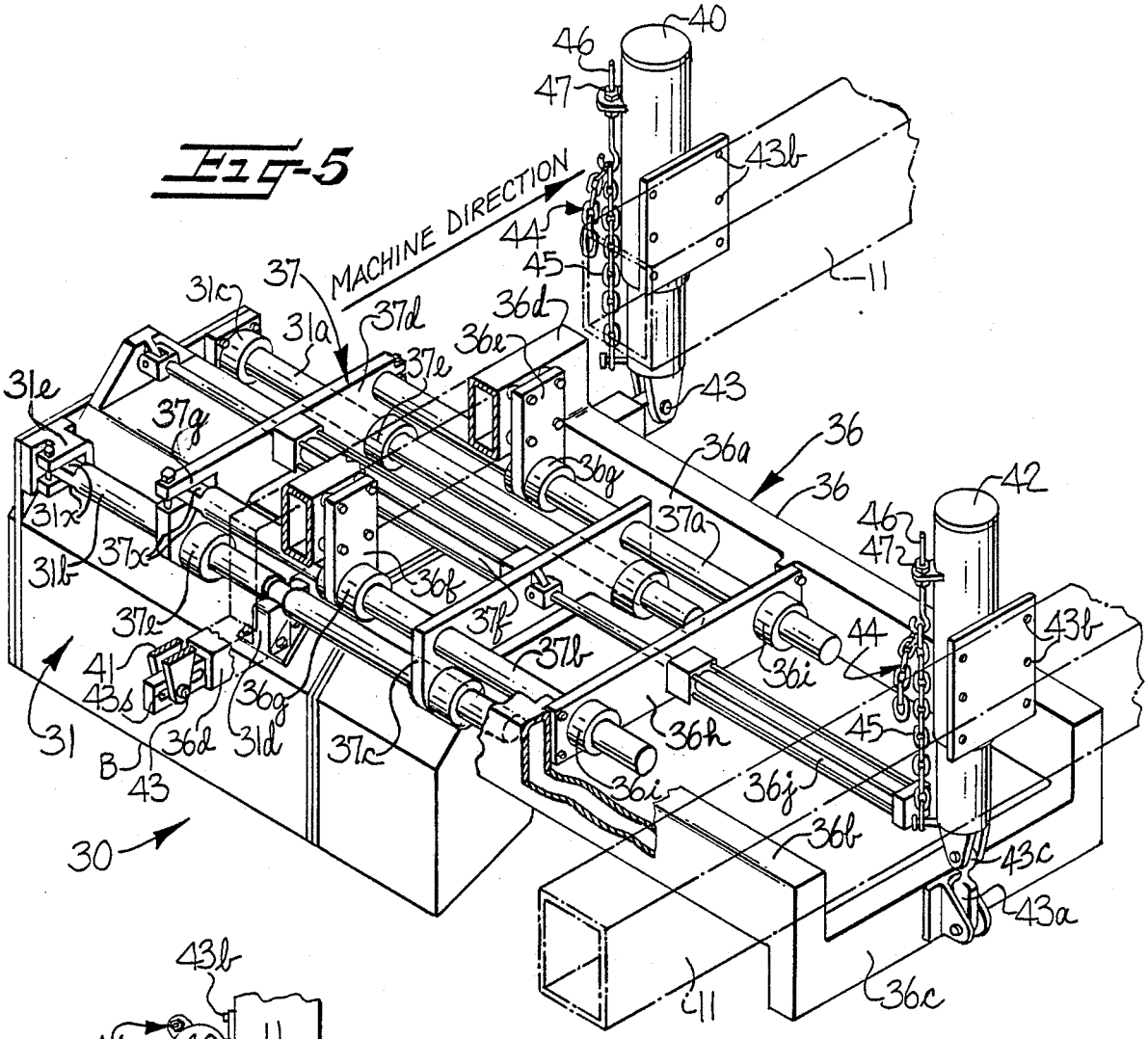
FIG. 5 is a perspective view of the trimmer apparatus looking in the direction of arrow 5 in FIG. 4, with portions broken away for clarity, and showing the earth grading means of the trimmer apparatus partially moved outwardly to one side of the main frame of the construction apparatus.
Figure 6:
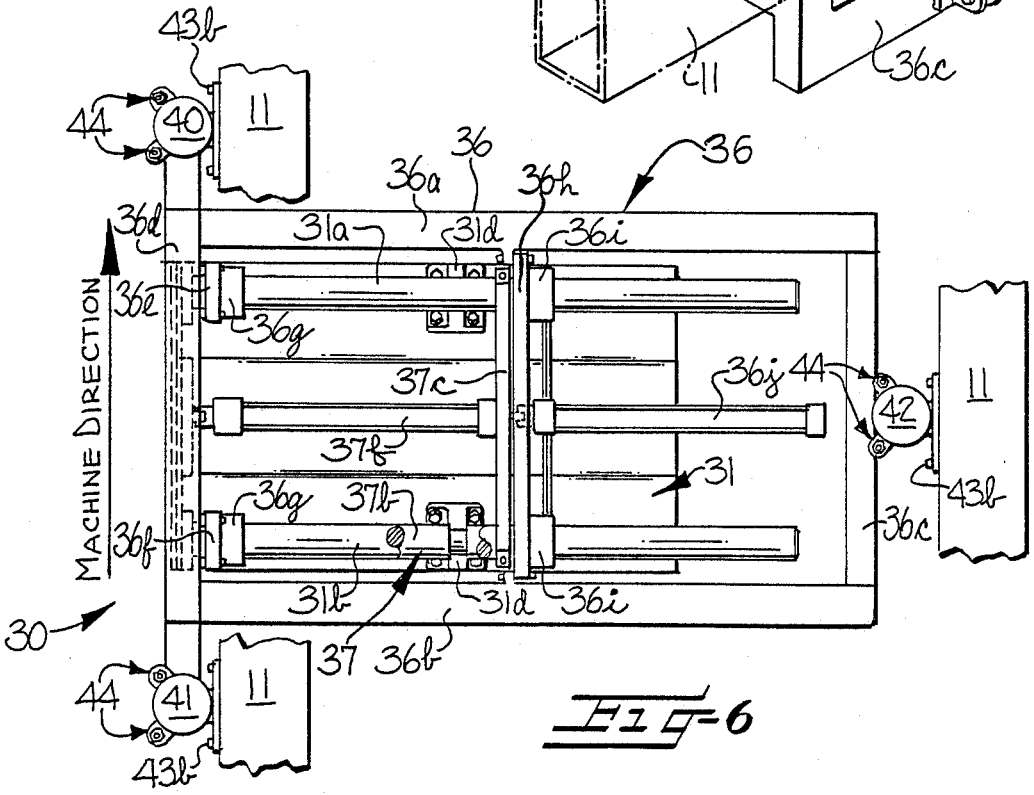
FIG. 6 is a top plan view of the trimmer apparatus shown in the retracted position relative to the main frame of the construction apparatus.

Turning now to the carriage, it is seen that in the preferred construction, as shown particularly in FIG. 5, the carriage is comprised of a main carriage 36 and an auxiliary carriage 37. The carriage is fastened to the fluid actuated cylinder connectors 40, 41 and 42 as by fasteners 43. In this regard, a link 43*a* located near the bottom portion of fluid actuated cylinder connector 42 and a slide 43*s* located at the lower portion of fluid actuated cylinder connector 41 provide the necessary flexibility to allow the carriage to be moved into the various angles and attitudes while being held firmly beneath the main frame 11. The main carriage is comprised of a front rail 36*a*, a back rail 36*b*, an inside rail 36*c* and an outside rail 36*d*, which are all rigidly attached together as shown, such as by welding. Attached to the outside rail 36*d* is a pair of standards 36*e* and 36*f* each having a collar 36*g* at the lower end thereof for slidingly receiving a pair of parallel auxiliary slide bars 37*a* and 37*b*, respectively. To stabilize the back ends of the auxiliary slide bars 37*a* and 37*b*, a beam 36*h* which has collars 36*i* formed thereon is attached to the front and back rails 36*a* and 36*b*. The auxiliary bars 37*a* and 37*b* are slidably received in the collars 36*i* as shown. The auxiliary carriage is comprised of the auxiliary slide bars 37*a* and 37*b*, an inside plate 37*c* attached to the ends of the slide bars 37*a* and 37*b*, and an outside plate 37*d* is attached to the auxiliary slide bars 37*a* and 37*b* at an intermediate position thereof. Attachment of the plates 37*c* and 37*d* can be by any conventional means, such as by bolts. The auxiliary bar 37*b* is provided with flats 37*x* to slide in clamping block 37*g*, so that the alignment of auxiliary bar 37*b* may be adjusted. The auxiliary carriage 34 slides as a unit relative to the main carriage 36 by virtue of the parallel auxiliary slide bars 37*a* and 37*b* sliding in the collars 36*g* and 36*i* and action of the fluid pressure actuator 36*j*.

The earth grading means 31 is mounted to the auxiliary carriage to move outwardly much like the auxiliary carriage is mounted to the main carriage. Incorporated into the inside plate 37*c* and outside plate 37*d* are collars 37*e* which slidingly receive the trimmer slide bars 31*a* and 31*b*. The trimmer slide bars 31*a* and 31*b* are attached to the earth grading means 31 by suitable means such as brackets 31*c*, 31*d*, and clamping block 31*e*. The trimmer slide bar 31*b* is provided with flats 31*x* to slide in the clamping block 31*e*, so that the alignment of auxiliary bar 31*b* may be adjusted. The earth grading means 31 is moved outwardly by a fluid pressure actuator 37*f* which is attached to the auxiliary carriage between the inside plate 37*c* and the outside plate 37*d*.

Figure 7:
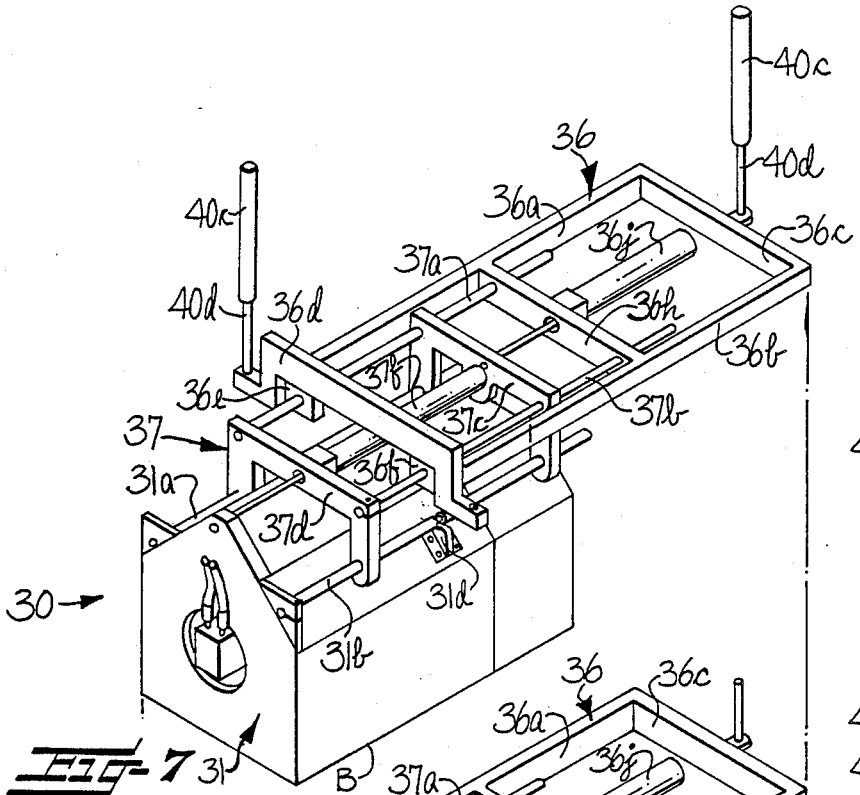
FIG. 7 is a schematic perspective view of the trimmer apparatus, with parts broken away for clarity, and showing the earth grading means of the apparatus trimmer in its fully extended position.
Figure 8:
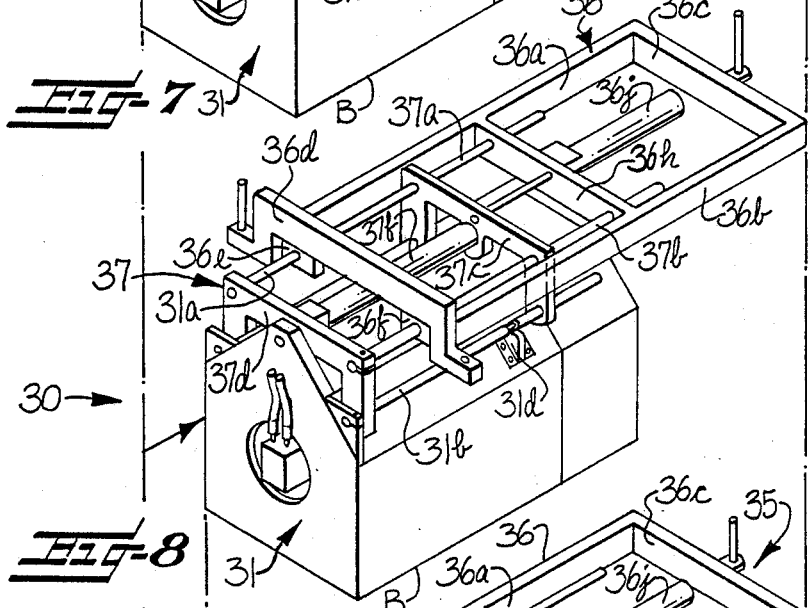
FIG. 8 is a schematic perspective view similar to FIG. 7 showing the earth grading means partially extended.
Figure 9:
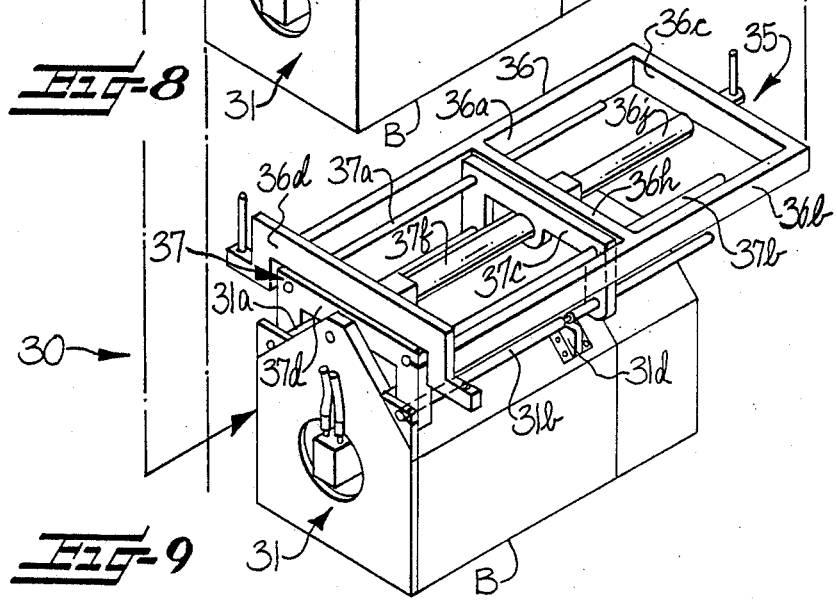
FIG. 9 is another schematic perspective view of the trimmer apparatus wherein the earth grading means is in its fully retracted position.

As shown schematically in FIG. 7, 8 and 9, the earth grading means is arranged to extend laterally. In FIG. 7, both the fluid pressure actuators 36*j* and 37*f* are fully extended causing the earth grading means to be fully extended. In FIG. 8, the earth grading means 31 is retracted to the auxiliary carriage by retracting the actuator 36*j*. However, the auxiliary carriage 37 is still fully extended from the main carriage. The fluid actuators 36*j* and 37*f* are envisioned to be separately controlled by the operator so that lateral movement of the earth grading means is accomplished by operation of actuators 36*j* and 37*f* individually or at the same time. In FIG. 9, the earth grading means is in its fully retracted position wherein the earth grading means 31 and auxiliary carriage 37 would underlie the main carriage 36. In these figures it can be easily seen that outside rail 36*d* is positioned higher relative to the front and back rails 36*a* and 36*b* to form an archway. The archway allows for a more compact carriage where, as can be seen in the figures, the auxiliary carriage 37 is received between the front and back rails 36*a* and 36*b*.

In some instances, it may be desirable to concurrently mold and grade off the right side of the machine. To mount the trimmer to extend from the other side of the machine will require some reassembly of the trimmer apparatus. The fluid actuated cylinder connectors 40, 41 and 42 which are attached to the main frame by bolts 43*b* (FIG. 6), are repositioned to the opposite sides of the machine. The carriage 35 is reattached to extend from the other side. The earth grading means 31 is disconnected from the auxiliary carriage 37 at brackets 31*c* and 31*d*, turned around and reattached. The trimmer is therefore able to extend from each side of the construction apparatus as the job requires.

In the drawings and specification, a preferred embodiment of the invention has been illustrated and described, and although specific terms are employed, they are used in a generic and descriptive sense and not for purposes of limitation.

We claim:

1. A self-propelled construction apparatus for grading a ground surface in preparation for forming a strip of paving material on the graded ground surface, said apparatus comprising a main frame, movable ground engaging means connected to said main frame for supporting said main frame, prime mover means carried by said main frame and being operatively connected to said movable ground engaging means to provide propulsion for the construction apparatus, trimmer means positioned below said main frame and extending laterally of said main frame for grading the ground surface, and means adjustably connecting said trimmer means to said main frame for providing an individually adjustable three-point suspension of said trimmer means wherein each point of said three-point suspension is individually adjustable for adjusting the angle of the trimmer means relative to said main frame in accordance with the desired slope or grade of the ground surface, adjusting the angle of attack of the trimmer means, and also for raising and lowering of the trimmer means relative to the main frame.

2. Apparatus according to claim 1, wherein said prime mover means is operatively connected to said means adjustably connecting said trimmer means to said main frame.

3. A self-propelled construction apparatus for grading a ground surface in preparation for forming a strip of paving material on the graded ground surface, said apparatus comprising a main frame, movable ground engaging means connected to said main frame for supporting said main frame, prime mover means carried by said main frame and being operatively connected to said movable ground engaging means to provide propulsion for the construction apparatus, trimmer means positioned below said main frame and extending laterally of said main frame for grading the ground surface, said trimmer means comprising earth grading means, a carriage connected to said main frame and dependingly supporting said earth grading means therefrom for lateral movement relative to said main frame, and said apparatus further comprising means adjustably connecting said carriage to said main frame for providing an individually adjustable three-point suspension of said trimmer means wherein each point of said three-point suspension is individually adjustable for adjusting the angle of the trimmer means relative to said main frame in accordance with the desired slop or grade of the ground surface, adjusting the angle of attack of the trimmer means, and also for raising and lowering of the trimmer means relative to the main frame.

4. An apparatus for grading a ground surface in preparation for forming a strip of paving material on the graded ground surface, said apparatus comprising a main frame, trimmer means positioned below said main frame and extending laterally of said main frame for grading the ground surface, and means connecting said trimmer means to said main frame for providing an individually adjustable three-point suspension of said trimmer means wherein each point of said three-point suspension is individually adjustable for adjusting the angle of the trimmer means relative to said main frame in accordance with the desired slope or grade of the ground surface, adjusting the angle of attack of the trimmer means, and also for raising and lowering of the trimmer means relative to the main frame.

5. Apparatus according to claim 4, wherein said connecting means comprises fluid pressure means and said apparatus further comprises limiting means adjacent said fluid pressure means for holding said trimmer means in a predetermined position relative to said main frame against the force of said fluid pressure means.

6. Apparatus according to claim 4, wherein said trimmer means comprises a carriage connected to said main frame, earth grading means connected to and depending from said carriage and mounted for lateral movement relative to said carriage, and actuator means for moving said earth grading means from a retracted position wherein said earth grading means underlies said carriage to an extended position wherein said earth grading means extends outwardly laterally beyond said carriage.

7. Apparatus according to claim 4, wherein said trimmer means comprises earth grading means, a carriage connected to said main frame, said carriage comprising a main carriage and an auxiliary carriage connected to and depending from said main carriage and mounted for lateral movement relative to said main carriage, said earth grading means being connected to and depending from said auxiliary carriage and mounted for lateral movement relative to said auxiliary carriage, a plurality of actuator means operatively connected to said carriage and said earth grading means for moving both said auxiliary carriage and said earth grading means from a retracted position wherein said auxiliary carriage and said earth grading means underlie said main carriage to an extended position wherein said auxiliary carriage extends outwardly laterally beyond said main carriage and said earth grading means extends outwardly laterally beyond said auxiliary carriage.

8. Apparatus according to claim 4, wherein said trimmer means comprises a carriage connected to said main frame, earth grading means connected to and depending from said carriage and mounted for lateral movement relative to said carriage, actuating means for moving said earth grading means from a retracted position wherein said earth grading means underlies said carriage to an extended position laterally outwardly beyond said carriage, and one end of said carriage having an archway permitting construction of a more compact trimmer means, and wherein said one end of said carriage corresponds to the end from which the earth grading means extends outwardly.

9. A self-propelled construction apparatus for concurrently grading a ground surface and forming a strip of paving material on the graded ground surface, said apparatus comprising a main frame, movable ground engaging means connected to said main frame for supporting said main frame, prime mover means carried by said main frame and being operatively connected to said movable ground engaging means to provide propulsion for the construction apparatus, molding means connected to said main frame for forming the strip of paving material on the ground, trimmer means positioned below said main frame and extending laterally of said main frame and forwardly of said molding means for grading the ground surface ahead of the molding means, said trimmer means comprising earth grading means, a carriage comprising a main carriage and an auxiliary carriage connected to and depending from said main carriage and mounted for movement relative to said main carriage, said earth grading means being connected to and depending from said auxiliary carriage, a plurality of actuator means operatively connected to said carriage and said earth grading means for moving both said auxiliary carriage and said earth grading means from a retracted position wherein said auxiliary carriage and said earth grading means underlie said main carriage to an extended position wherein said auxiliary carriage extends outwardly laterally beyond said main carriage and said earth grading means extends outwardly laterally beyond said auxiliary carriage.

10. Apparatus according to claim 9, wherein said auxiliary carriage comprises a pair of parallel slide bars that are carried by and slidably received by said main carriage, and said earth grading means comprises a pair of parallel slide bars that are carried by and slidably received by said auxiliary carriage.

11. Apparatus according to claim 9, wherein said auxiliary carriage comprises a pair of parallel slide bars that are carried by and slidably received by said main carriage, and wherein said earth grading means includes a pair of slide bars that are slidably received by said auxiliary carriage, and wherein said plurality of actuator means comprises first fluid pressure actuator means interconnecting said main carriage and said auxiliary carriage for effecting movement of said auxiliary carriage between said retracted position and said extended position, and second fluid pressure actuator means interconnecting said earth grading means and said auxiliary carriage for effecting movement of said earth grading means between said extended position and said retracted position.

12. A self-propelled construction apparatus for concurrently grading a ground surface and forming a strip of paving material on the graded ground surface, said apparatus comprising a main frame, movable ground engaging means connected to said main frame for supporting said main frame, prime mover means carried by said main frame and being operatively connected to said movable ground engaging means to provide propulsion for the construction apparatus, molding means connected to said main frame for forming a strip of paving material on the ground, trimmer means positioned below said main frame and extending laterally of said main frame and forwardly of said molding means for grading the ground surface ahead of said molding means, said trimmer means comprising earth grading means, a carriage comprising a main carriage and an auxiliary carriage connected to and depending from said main carriage and mounted for lateral movement relative to said main carriage, said earth grading means being connected to and depending from said auxiliary carriage, and a plurality of fluid pressure actuator means operatively connected to said carriage and said earth grading means for moving both said auxiliary carriage and said earth grading means from a retracted position wherein said auxiliary carriage and said earth grading means underlie said main carriage to an extended position wherein said auxiliary carriage extends outwardly laterally beyond said main carriage and said earth grading means extends outwardly laterally beyond said auxiliary carriage, said construction apparatus further comprising fluid pressure means connecting said main carriage to said main frame so as to provide an individually adjustable three-point suspension of said trimmer means for adjusting the angle of the trimmer means relative to said main frame in accordance with the desired slope or grade of the ground surface, and for raising and lowering of the trimmer means relative to the main frame.

13. A construction apparatus for grading a ground surface in preparation for forming a strip of paving material on the graded ground surface, said apparatus comprising a main frame, trimmer means comprising earth grading means, a carriage connected to said earth grading means for dependingly supporting said earth grading means therefrom, said carriage comprising a main carriage and an auxiliary carriage connected to and depending from said main carriage and mounted for movement relative to said main carriage, said earth grading means being connected to and depending from said auxiliary carriage for lateral movement relative to said auxiliary carriage, and a plurality of actuator means operatively connected to said carriage and said earth grading means for moving both said auxiliary carriage and said earth grading means from a retracted position wherein said auxiliary carriage and said earth grading means underly said main carriage to an extended position wherein said auxiliary carriage extends outwardly laterally beyond said main carriage and said earth grading means extends outwardly laterally beyond said auxiliary carriage.

14. A construction apparatus for grading a ground surface in preparation for forming a strip of paving material on the graded ground surface, said apparatus comprising a main frame, trimmer means positioned below said main frame and extending laterally of said main frame for grading the ground surface, said trimmer means comprising earth grading means, a carriage connected to said earth grading means for dependingly supporting said earth grading means therefrom for lateral movement relative to said carriage, and actuator means connected to said carriage for moving said earth grading means from a retracted position wherein said earth grading means underlies said carriage to an extended position wherein the earth grading means extends outwardly laterally beyond said carriage, and said construction apparatus further comprising means connecting said carriage to said main frame so as to provide an individually adjustable three-point suspension of said trimmer means for adjusting the angle of the trimmer means relative to said main frame in accordance with the desired slope or grade of the ground surface, and for raising and lowering of the trimmer means relative to the main frame.

15. A construction apparatus for concurrently grading a ground surface and forming a strip of paving material on the graded ground surface, said apparatus comprising a main frame, molding means connected to said main frame for forming the strip of paving material on the ground, trimmer means positioned below said main frame and extending laterally of said main frame and forwardly of said molding means for grading the ground surface ahead of the molding means, and means connecting said trimmer means to said main frame for providing an individually adjustable three-point suspension of said trimmer means wherein each point of said three-point suspension is individually adjustable for adjusting the angle of the trimmer means relative to said main frame in accordance with the desired slope or grade of the ground surface, adjusting the angle of attach of the trimmer means, and also for raising and lowering of the trimmer means relative to the main frame.

16. A trimmer for grading the ground and adapted to be mounted on and carried by a construction apparatus, said trimmer comprising earth grading means, a carriage connected to said earth grading means for dependingly supporting said earth grading means therefrom, said carriage comprising a main carriage and an auxiliary carriage connected to and depending from said main carriage and mounted for lateral movement relative to said main carriage, said earth grading means being connected to and depending from said auxiliary carriage for movement relative to said auxiliary carriage, a plurality of actuator means operatively connected to said carriage and said earth grading means for moving both said auxiliary carriage and said earth grading means from a retracted position wherein said auxiliary carriage and said earth grading means underlie said main carriage to an extended position wherein said auxiliary carriage extends outwardly laterally beyond one end of said main carriage and said earth grading means extends outwardly laterally beyond said auxiliary carriage.

17. A trimmer according to claim 16, wherein said auxiliary carriage comprises a pair of parallel slide bars that are carried by and slideably received by said main carriage, and said earth grading means comprises a pair of parallel slide bars that are carried by and slideably received by said auxiliary carriage.

18. A trimmer according to claim 16, wherein said auxiliary carriage comprises a pair of parallel slide bars that are carried by and slidably received by said main carriage, and wherein said earth grading means includes a pair of slide bars that are slidably received by said auxiliary carriage, and wherein said plurality of actuator means comprises first fluid pressure actuator means interconnecting said main carriage and said auxiliary carriage for effecting movement of said auxiliary carriage between said retracted position and said extended position, and second fluid pressure actuator means interconnecting said earth grading means and said auxiliary carriage for effecting movement of said earth grading means between said extended position and said retracted position.

19. A trimmer according to claim 16, wherein one end of said main carriage has an archway permitting construction of a more compact carriage, and wherein said archway is positioned on said one end of said main carriage from which the auxiliary carriage and said earth grading means are extendable.

* * * * *

UNITED STATES PATENT AND TRADEMARK OFFICE

CERTIFICATE OF CORRECTION

PATENT NO. : 4,808,026

DATED : February 28, 1989

INVENTOR(S) : Samuel Y. Clarke, Jr. et al.

It is certified that error appears in the above-identified patent and that said Letters Patent is hereby corrected as shown below:

Column 4, line 8, delete "34" and insert --37--.

Column 8, line 54, delete "attach" and insert --attack--.

Signed and Sealed this

Twenty-second Day of August, 1989

*Attest:*

DONALD J. QUIGG

*Attesting Officer*

*Commissioner of Patents and Trademarks*